US007787643B2

(12) United States Patent
Michel

(10) Patent No.: US 7,787,643 B2
(45) Date of Patent: Aug. 31, 2010

(54) SYSTEM AND METHOD FOR RF IMMUNITY OF ELECTRET CONDENSER MICROPHONE

(75) Inventor: Alan D. Michel, Fishers, IN (US)

(73) Assignee: MWM Acoustics, LLC, Indianapolis, IN (US)

( * ) Notice: Subject to any disclaimer, the term of this patent is extended or adjusted under 35 U.S.C. 154(b) by 1440 days.

(21) Appl. No.: 11/186,564

(22) Filed: Jul. 21, 2005

(65) Prior Publication Data

US 2006/0109998 A1 May 25, 2006

Related U.S. Application Data

(60) Provisional application No. 60/631,065, filed on Nov. 24, 2004.

(51) Int. Cl.
*H04R 25/00* (2006.01)

(52) U.S. Cl. ..... 381/174; 381/369

(58) Field of Classification Search ..... 381/113, 381/170, 173, 174, 175, 176, 181, 191, 355, 381/369, 396, 398; 29/25.41, 594
See application file for complete search history.

(56) References Cited

U.S. PATENT DOCUMENTS 5,589,799 A * 12/1996 Madaffari et al. ..... 381/120
6,904,155 B2 * 6/2005 Yonehara et al. ..... 381/369
7,054,458 B2 * 5/2006 Ito et al. ..... 381/174

* cited by examiner

*Primary Examiner*—Brian Ensey
(74) *Attorney, Agent, or Firm*—Ice Miller LLP

(57) ABSTRACT

A system and method for RF immunity of an electret condenser microphone. In one embodiment, the microphone comprises a printed wire board, an amplifier, a capacitor. The amplifier and the capacitor are mounted on the printed wire board such that longitudinal axis, i.e., the axis defined by the line between the output pin and the ground pin, of the capacitor is perpendicular to the longitudinal axis of the amplifier. According to one embodiment of the method of the present invention, an electret condenser microphone according to the present invention is provided, and current is provided to the capacitor to result in the creation of a magnetic field about the longitudinal axis of the capacitor. The magnetic field created is positioned such that it does not significantly contribute to the generation of RF current in the amplifier.

6 Claims, 5 Drawing Sheets

PRIOR ART

SYSTEM AND METHOD FOR RF IMMUNITY OF ELECTRET CONDENSER MICROPHONE

RELATED APPLICATIONS

This is a non-provisional patent application based on U.S. provisional patent application Ser. No. 60/631,065, filed Nov. 24, 2004.

BACKGROUND OF THE INVENTION

The present invention relates to electret condenser microphones, and, more particularly, to a system and method for improved RF immunity of an electret condenser microphone.

Electret condenser microphones find application in a myriad of applications. For example, speakerphones and telephone handsets often use electret condenser microphones. Speakerphones generally are a high gain system that may use small electret condenser microphones and use radio frequency ("RF") technology to transmit and receive voice data. Handsets often use lower microphone gain as the microphone is close to the desired audio source, i.e., a voice.

The RF technology often used in systems including electret condenser microphones are common RF modulation schemes, such as the global system for mobile communication ("GSM") standard, the digital enhanced cordless telecommunications ("DECT") standard, cellular standards, or the time division multiple access ("TDMA") standard. These common schemes generally send data in bursts or packets over microwave frequency bands. The RF signal is demodulated at the microphone's junction field effect transistor ("JFET") internal amplifier. This demodulation corrupts the audio output signal with objectionable noise.

More specifically, in these transmission schemes, the carrier transmits the audio in the form a digital burst or data packet that is compressed in time. Such compression causes the RF energy to be transmitted in bursts. Demodulation, by the PN junction of the JFET amplifier in the microphone of the energy bursts, can result in audible interference, and, hence, corruption of the audio output signal. Typical transmission rates for these time multiplexed packets are on the order of 5, 10, or 20 milliseconds of voice data transmitted in a much shorter duration packet each 5, 10, or 20 millisecond period.

The microphone cable, i.e., the connecting cable connected to the terminals of the microphone and the system of which the microphone is a part, normally acts like an antenna. Thus, the microphone cable picks up some of the RF energy being transmitted by the system that contains the microphone, and then conducts the picked up RF energy to the microphone terminals.

Prior art systems may be useful in applications where microphone gain is not too high, such as handset use where the microphone is close to the mouth) and does not require much amplification of the microphone's output signal. In cases, such as wireless speakerphones, that require much higher microphone gains, in addition to the placement of capacitors, are generally not effective and, thus, the microphone element usually must be shielded by using ferrite beads, conductive tape, or other methods to reduce the RF energy seen by the JFET amplifier. Such shielding assists in preservation of a reasonable signal to noise ratio, but adds significant expense to the manufacture of such electret condenser microphones.

It is desired to provide a system and method with improved RF immunity for an electret condenser microphone. It is also desired for such a system and method to be effective in systems using common RF transmission schemes. It is further desired to provide a system and method that does not introduce significant cost to the manufacture of a system including at least one electret condenser microphone.

SUMMARY OF THE INVENTION

Figure 1B:
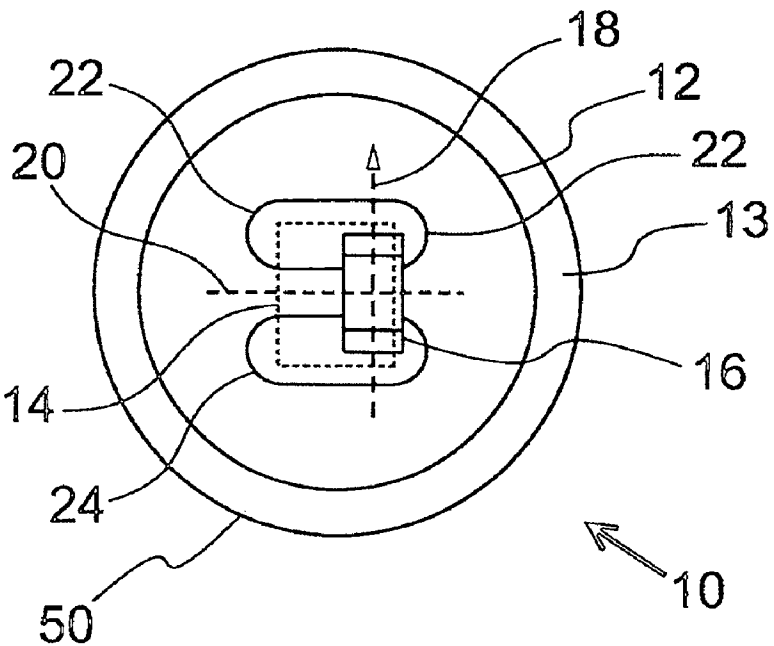
FIG. 1B PRIOR ART
FIG. 1B shows a diagrammatic top view of the electret condenser microphone of FIG. 1A according to prior art.

The present invention involves the placement of capacitors in a new and novel position and geometry on the back of the electret condenser microphone. The invention allows for minimization of the RF magnetic fields seen by the internet JFET amplifier from RF energy conducted to the microphone by the microphone's connecting cable.

In one embodiment, the electret condenser microphone comprises a printed wire board, an amplifier having a longitudinal axis, and a capacitor having a longitudinal axis. The amplifier and capacitor are mounted on the printed wire board such that the longitudinal axis of the capacitor is perpendicular to the longitudinal axis of the amplifier.

In another embodiment, the electret condenser microphone comprises a printed wire board, an amplifier having a longitudinal axis mounted on the printed wire board, and a plurality of capacitors each having a longitudinal axis. The plurality of capacitors are also mounted on the printed wire board in a manner such that magnetic fields generated by RF currents flowing through each of the plurality of capacitors tend to cancel each other in the vicinity of the amplifier.

According to one method of the present invention to improve RF immunity of an electret condenser microphone, first, an electret condenser microphone comprising a single capacitor according to the present invention is provided, and, second, current is provided to the capacitor to result in creation of a magnetic field about the longitudinal axis of the capacitor. According to another method, first, an electret condenser microphone comprising a plurality of capacitors is provided, and, second, current is provided to the plurality of capacitors such that the magnetic fields generated by RF currents flowing through each of the plurality of capacitors tend to cancel each other the vicinity of the amplifier.

Another method of the present invention comprises the first step of providing a printed wire board, an amplifier having a longitudinal axis, and a capacitor having a longitudinal axis. Next, the amplifier is mounted on the printed wire board. Then, the capacitor is mounted on the printed wire board such that the longitudinal axis of the capacitor is perpendicular to the longitudinal axis of the amplifier. In another embodiment of such method, the first step involves provision of a printed wire board, an amplifier having a longitudinal axis, and a plurality of capacitors each having a longitudinal axis. The amplifier is then mounted on the printed wire board. Next, the plurality of capacitors are mounted on the printed wire board in a manner such that magnetic fields generated by RF currents flowing through each of the plurality of capacitors tend to cancel each other in the vicinity of the amplifier.

The electret condenser microphone and methods of the present invention significantly reduce the generation of magnetic fields to affect the amplifier when compared to the prior art. Thus, the RF immunity of the electret condenser microphone is improved. This advantage is realized in a cost effective manner and by the use of common electronic components and methods.

DETAILED DESCRIPTION OF THE INVENTION

The present invention comprises a system and method for improving RF immunity of an electret condenser microphone.

Figure 1A:
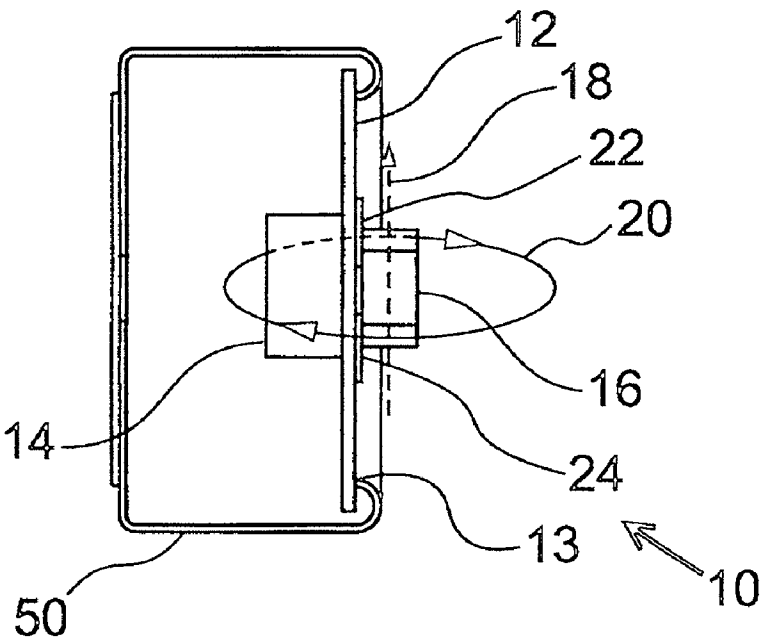
FIG. 1A shows a diagrammatic side view of an electret condenser microphone according to the prior art.

Referring now to FIG. 1A and FIG. 1B, there are shown a diagrammatic side view and a diagrammatic top view of an electret condenser microphone according to the prior art. Prior art microphone 10 includes printed wire board ("PWB") 12, conductive ring 13, JFET 14, capacitor 16, and housing 50. JFET 14 mounted on PWB 12 according to mechanisms well-known in the art. Capacitor 16 is also mounted on PWB 12 by mechanisms well-known in the art to the opposite side of the PWB. In this embodiment, capacitor 16 is electrically connected to first solder pad 22 and second solder pad 24 on PWB 12. As seen in both FIG. 1A and FIG. 1B, capacitor 16 and JFET 14 are aligned such that their respective longitudinal axes are parallel to each other. Longitudinal axis 18 of capacitor 16 is illustrated in FIG. 1A and FIG. 1B. A magnetic field results from RF current flowing through capacitor 16 and is shown in FIG. 1 and FIG. 1B as magnetic field 20. As seen in FIG. 1A, magnetic field 20 encircles 14 JFET about the longitudinal axis of the JFET. The magnetic field generated by RF current flowing through capacitor 16 an illustrated by magnetic field 20 also creates an RF current in JFET 14 as well.

In this embodiment of the prior art shown in FIG. 1A and FIG. 1B, capacitor 16 and JFET 14 are in parallel—both electrically and physically. As used in herein, and in the claims, the term "longitudinal axis" refers to the axis defined by the line between the output pin and the ground pin of the device. The "longitudinal axis is, therefore, not necessarily the axis of the longest dimension of the packaging of the device.

Figure 2B:
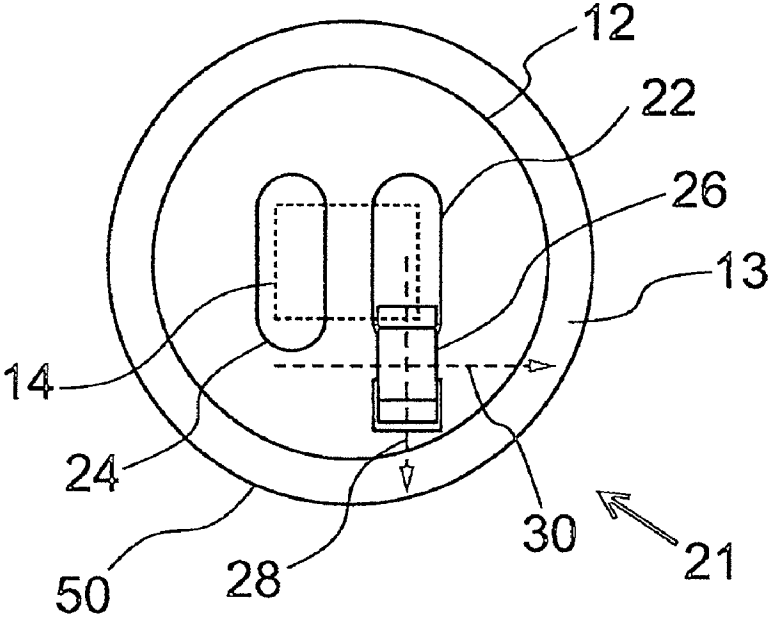
FIG. 2B shows a diagrammatic top view of the embodiment of the electret condenser microphone of FIG. 2A.
Figure 2A:
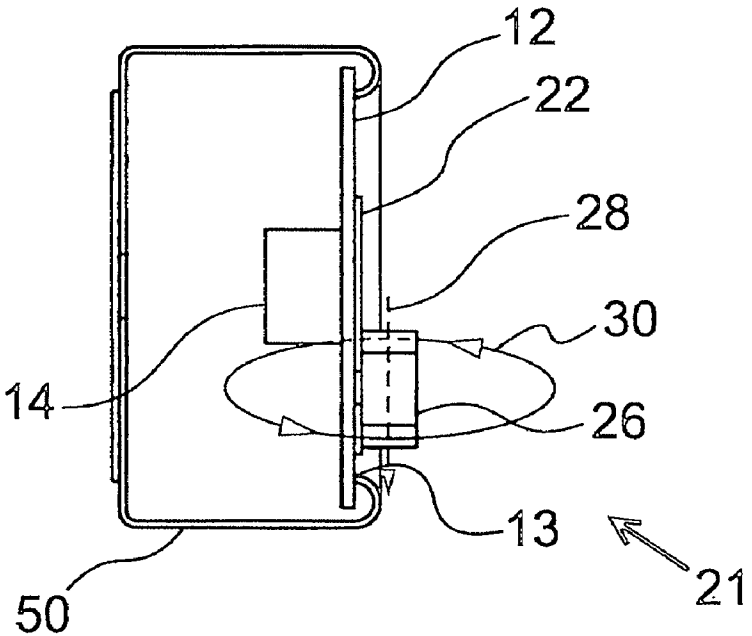
FIG. 2A shows a diagrammatic side view of one embodiment of an electret condenser microphone according to the present invention.

FIG. 2A and FIG. 2B show a diagrammatic side view and a diagrammatic top view of one embodiment of an electret condenser microphone according to the present invention. In this embodiment, microphone 21 includes capacitor 26 mounted to PWB 12 to be in electrical contact with first solder pad 22 and conductive ring 13. Capacitor 26 is mounted in an orientation such that longitudinal axis 28 of capacitor 26 is perpendicular to the longitudinal axis of JFET 14. Also, in this embodiment, capacitor 26 is offset from JFET 14—capacitor 16 and JFET 14 are not located on direct opposite sides of PWB 12 as is the case with the prior art microphone shown in FIG. 1A and FIG. 1B. In the embodiment of FIG. 2A and FIG. 2B, JFET 14 and capacitor 26 are electrically in parallel, but are physically orthogonal. In this manner, the magnetic field from RF current flowing through capacitor 16, as represented by magnetic field 30, does not encircle JFET 14, and thus minimizes any RF current in JFET 14 resulting from a magnetic field encircling the capacitor as in the prior art.

Figure 3B:
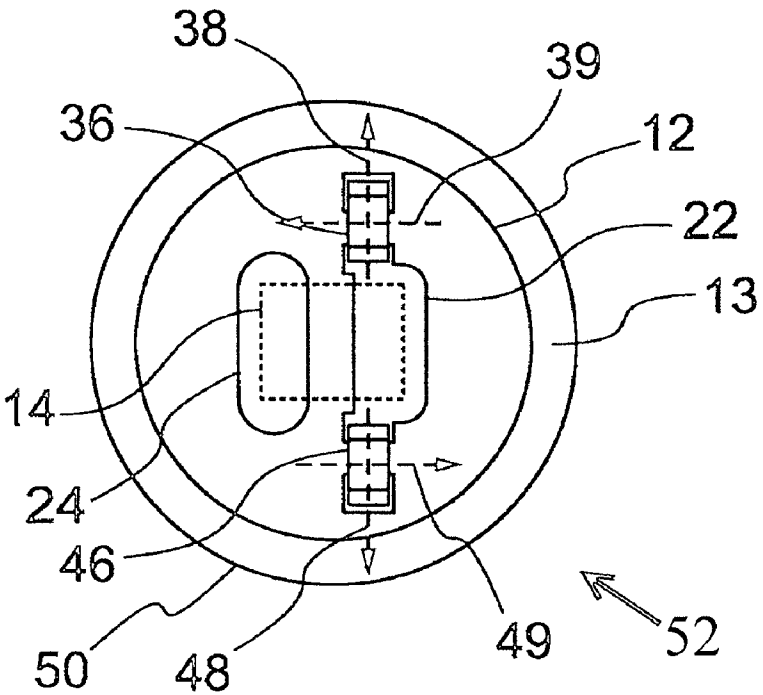
FIG. 3B shows a diagrammatic top view of the embodiment of the electret condenser microphone of FIG. 3A.
Figure 3A:
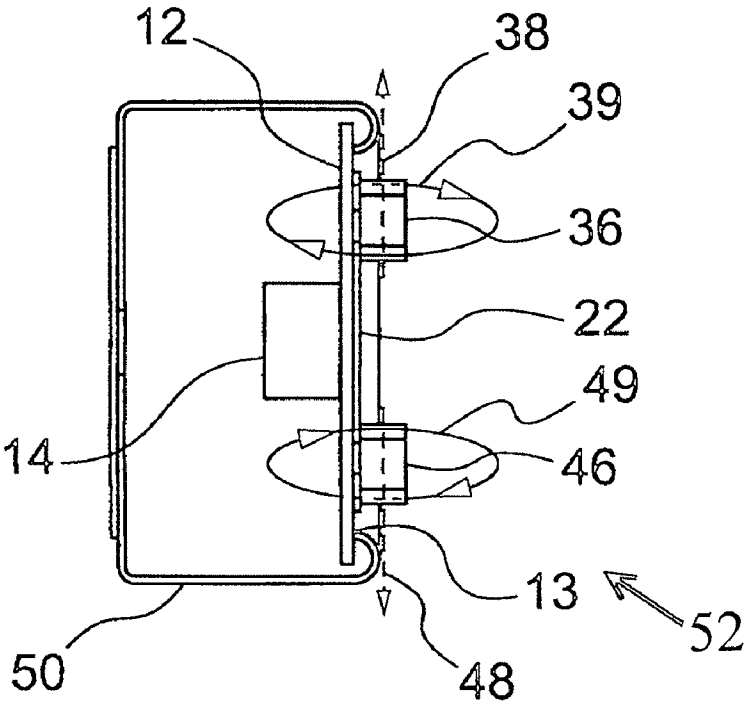
FIG. 3A shows a diagrammatic side view of another embodiment of an electret condenser microphone according to the present invention.

Referring now to FIG. 3A and FIG. 3B, there is shown a diagrammatic side view and a diagrammatic top view of another embodiment of an electret condenser microphone according to the present invention. In the embodiment of the present invention illustrated in FIG. 3A and FIG. 3B, the capacitance of the microphone 52 is split into two physical capacitors. Specifically, microphone 52 includes first capacitor 36 and second capacitor 46. Each of first capacitor 36 and second capacitor 46 are mounted on PWB in electrical contact with first solder pad 22 and conductive ring 13. Each of capacitors 36 and 46 are electrically in parallel with JFET 14, but are physically orthogonal to JFET 14. Specifically, first longitudinal axes 38 of first capacitor 36 and second longitudinal axis 48 of second capacitor 46 are both perpendicular to the longitudinal axis of JFET 14. Further, with respect to each other, first longitudinal axes 38 of first capacitor 36 and second longitudinal axis 48 of second capacitor 46 are oriented 180 degrees from each other. The use of and orientation of the two physical capacitors, namely, first and second capacitors 36 and 46, causes RF currents to flow in opposite directions. Thus, first magnetic field 39 created by the RF current of first capacitor 36 and second magnetic field 49 created by the RF current of second capacitor 38 are in opposite directions and to not encircle JFET 14. The opposing directions of magnetic fields 39 and 49 tend to cancel each other at the center position where JFET amplifier 14 is located.

Figure 3C:
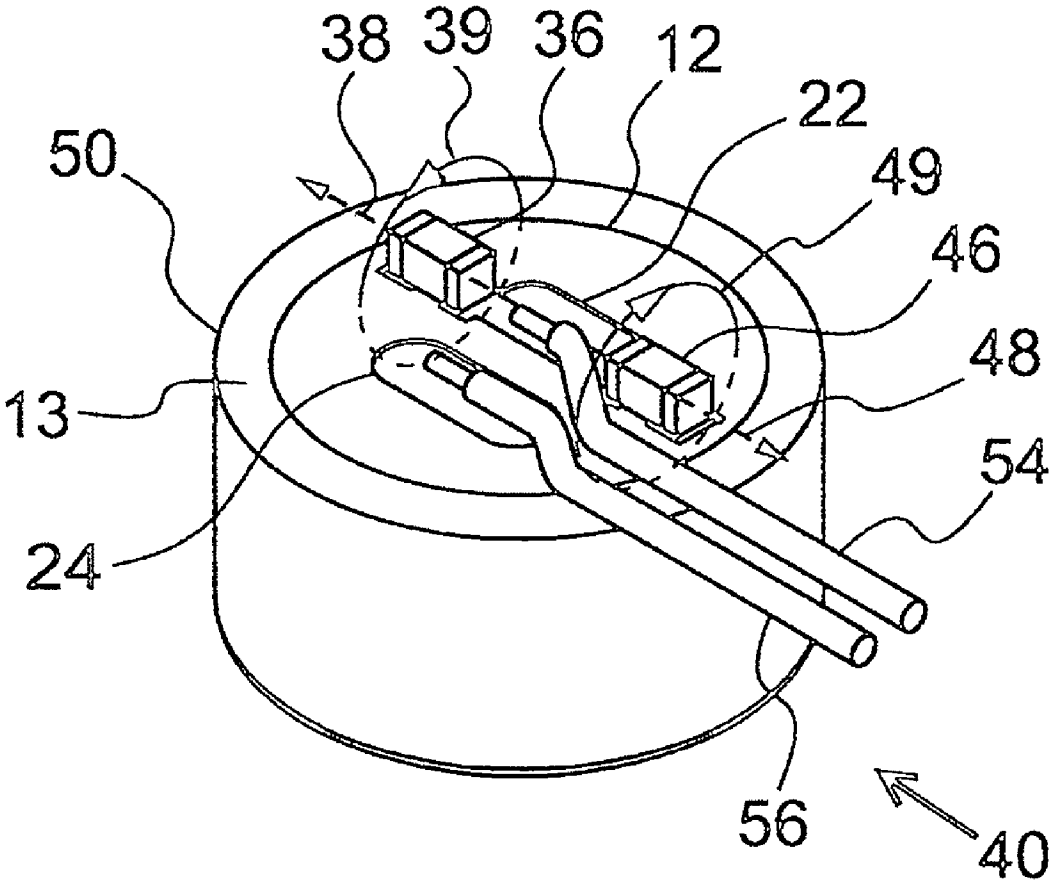
FIG. 3C shows a perspective bottom view of the electret condenser microphone of the embodiment of FIG. 3A and FIG. 3B.

FIG. 3C shows a perspective bottom view of the electret condenser microphone of the embodiment of FIG. 3A and FIG. 3B. In this embodiment, microphone assembly 40 includes a microphone, and first and second leads 54 and 56, electrically connected to first and second solder pads 22 and 24, respectively. In this embodiment, JFET 14 (see FIG. 3A and FIG. 3B) comprises a 2SK596 model manufactured by Sanyo, of Japan, and the microphone comprises a model CM9752RF-38FL microphone available from MWM Acoustics, LLC of Indianapolis, Ind., United States of America. First and second capacitor 36 and 46 each comprise a 5.6 pF capacitor such as is available from a multitude of sources.

Figure 4:
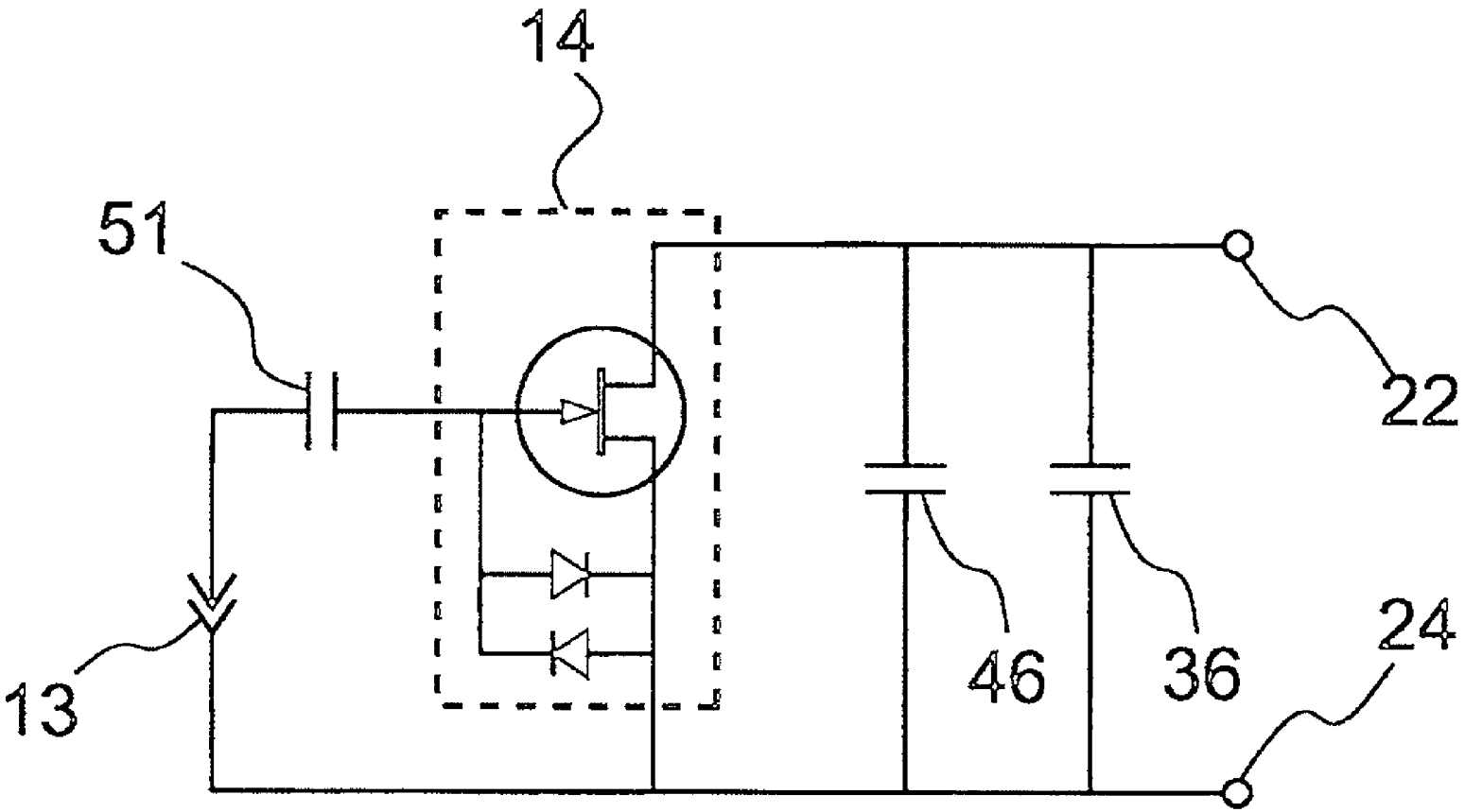
FIG. 4 shows a schematic of the embodiment of FIGS. 3A, 3B, and 3C.

Referring now to FIG. 4, there is shown a schematic of the embodiment of FIGS. 3A, 3B, and 3C. High impedance electret cell 51 is connected to amplifier 14 directly on one side, and through conductive ring 13 and pad 24 on the other side. Capacitors 36 and 46 are the two capacitors shown in FIGS. 3A, 3B, and 3C.

It will be appreciated by those of skill in the art that the use of two capacitors, such as in the embodiment of FIG. 3A, FIG. 3B, and FIG. 4 may be more expensive than the use of one capacitor in the embodiment of FIG. 2A and FIG. 2B. However, the cost of capacitors and cost of mounting capacitors on a PWB is minimal. Because performance is enhanced with the use of two capacitors, the additional cost may be acceptable, and, in fact, desired.

It will be appreciated by those of skill in the art that the present invention uses physical capacitors for RF immunity of electret condenser microphones. Prior art microphones place capacitors across the JFET on the back of the microphone or inside the microphone in parallel with the JFET. This placement is without regard to the magnetic field that RF currents flowing through the capacitor create around the capacitor. In contrast, the present invention uses placement of the capacitors in a new geometry that minimizes the RF magnetic fields seen by the JFET amplifier.

It will be further appreciated by those of skill in the art that a "distributed" capacitance could be used in place of the discrete capacitor component. Such distributed capacitance consists of parallel plates on the printed wire board ("PWB") that are circular in fashion, with the JFET amplifier located in the center of the circle. Such distributed capacitance is contemplated to be within the scope of the present invention.

It will be yet further appreciated that the present invention reduces the amount of electrical noise caused by demodulation of RF when the RF system uses a burst-based or packet-based transmission scheme. As shown in FIG. 2A and FIG. 2B and in FIG. 3A and FIG. 3B, the invention is useful in both low gain applications, such as a handset, and high gain applications, such as a speakerphone.

It will also be appreciated that, while FIGS. 2A and 2B and FIGS. 3A and 3B illustrate the use of one or two capacitors, it is within the scope of the invention to include any number of capacitors for the capacitance required. Such capacitors should be electrically in parallel with the JFET, and be physically orthogonal to the JFET and/or such capacitors should be oriented in a manner that the magnetic fields resulting from RF current flowing through the capacitors should oppose each other to tend to cancel at the position where the JFET is located. As another example, the capacitance may be distributed among three capacitors oriented such the legs of a "Y" and positioned with respect to the JFET so that the magnetic fields resulting from RF current flowing through the three capacitors tend to cancel at the position of the JFET.

In view of the many possible embodiments to which the principles of these invention may be applied, it should be recognized that the detailed embodiments are illustrative only and should be taken as limiting the scope of the invention. Rather, the invention comprises all such embodiments as may come within the scope and spirit of the invention and equivalents thereto.

I claim:

1. An electret condenser microphone, comprising:

a printed wire board;

an amplifier having a longitudinal axis, the amplifier mounted on the printed wire board;

a first capacitor having a longitudinal axis; and a second capacitor having a longitudinal axis, wherein the first capacitor and the second capacitor are mounted on the printed wire board such that the longitudinal axes of the first and second capacitor are perpendicular to the longitudinal axis of the amplifier and on opposing sides of the longitudinal axis of the amplifier.

2. The electret condenser microphone of claim 1, wherein the amplifier comprises a JFET amplifier.

3. An electret condenser microphone, comprising:

a printed wire board;

an amplifier having a longitudinal axis, the amplifier mounted on the printed wire board; and a plurality of capacitors, each of the plurality of capacitors having a longitudinal axes, and each of the plurality of capacitors mounted on the printed wire board in a manner such that magnetic fields generated by RF currents flowing through each of the plurality of capacitors tend to cancel each other in the vicinity of the amplifier.

4. The electret condenser microphone of claim 3, wherein the amplifier comprises a JFET amplifier.

5. A method for improving RF immunity of an electret condenser microphone, the method comprising the steps of:

providing an electret condenser microphone including a printed wire board, an amplifier having a longitudinal axis, and a plurality of capacitors, each of the plurality of capacitors having a longitudinal axis, the amplifier and the plurality of capacitors each mounted on the printed wire board such that magnetic fields generated by RF currents flowing through each of the plurality of capacitors tend to cancel each other in the vicinity of the amplifier; and providing current to the plurality of capacitors to result in creation of the magnetic fields about the longitudinal axes of the plurality of capacitors.

6. A method for improving RF immunity of an electret condenser microphone, the method comprising the steps of:

providing a printed wire board, an amplifier having a longitudinal axis, and a plurality of capacitors, each of the plurality of capacitors having a longitudinal axis;

mounting the amplifier on the printed wire board; and mounting the plurality of capacitors on the printed wire board such that magnetic fields generated by RF currents flowing through each of the plurality of capacitors tend to cancel each other in the vicinity of the amplifier.

* * * * *